United States Patent [19]

Yanagisawa

[11] Patent Number: 4,993,455

[45] Date of Patent: Feb. 19, 1991

[54] RECEIVER DRYER HEADER PORTION FOR AN AUTOMOBILE AIR CONDITIONING APPARATUS

[75] Inventor: Masahiro Yanagisawa, Gunma, Japan

[73] Assignee: Sanden Corporation, Gunma, Japan

[21] Appl. No.: 835,247

[22] Filed: Mar. 3, 1986

[30] Foreign Application Priority Data

Mar. 2, 1985 [JP] Japan ..... 60-29168[U]

[51] Int. Cl.[5] ..... E03B 11/00

[52] U.S. Cl. ..... 137/592; 137/575; 137/580; 62/509; 285/190

[58] Field of Search ..... 62/503, 474, 509; 285/190, 158, 272, 273; 137/576, 575, 573, 592, 590, 580, 615

[56] References Cited

U.S. PATENT DOCUMENTS 2,365,791 12/1944 Wineman ..... 62/509
2,400,658 5/1946 Shepard ..... 285/190
2,691,279 10/1954 Anderson ..... 62/509
2,732,169 6/1956 Matteo ..... 285/190
2,797,552 7/1957 Lacard ..... 62/509

*Primary Examiner*—A. Michael Chambers
*Attorney, Agent, or Firm*—Banner, Birch, McKie & Beckett

[57] ABSTRACT

An improved receiver dryer header portion for a refrigeration circuit is disclosed. The receiver dryer comprises a cylindrical body having an upper opening and a header portion disposed on the upper opening. The header portion includes a cover plate which is formed as step-like structure having a lower flat surface and an upper flat surface. A fluid inlet port is rotatably disposed on the lower flat surface and a fluid outlet port is rotatably disposed on the upper flat surface. This enables the fluid outlet port to rotate 360° and the fluid input port to rotate more than 180° thereby permitting the piping arrangement of the refrigeration circuit to be easily connected and properly sealed.

9 Claims, 4 Drawing Sheets

RECEIVER DRYER HEADER PORTION FOR AN AUTOMOBILE AIR CONDITIONING APPARATUS

TECHNICAL FIELD

The present invention relates to an improved receiver dryer used in an automobile air conditioning apparatus. More particularly, the present invention relates to an improved header portion of a receiver dryer used in an automobile air conditioning apparatus.

BACKGROUND OF THE INVENTION

Receiver dryer devices for use in an automobile air conditioning apparatus are well known in the prior art. The receiver dryer is generally disposed between a condenser and a decompression device of the air conditioning apparatus. As shown in FIG. 1*a*, which is a plan view of an earlier version of a receiver dryer, and FIG. 1*b*, which is a cross-sectional view of the same receiver dryer, housing 1 comprises cylindrical body 2 with an upper opening and header portion 3. Header portion 3 is welded on the top of cylindrical body 2 to cover the upper opening and is provided with integrally formed fluid ports 3*a* and 3*b*. Therefore, sealing the receiver dryer to the refrigeration circuit should be accomplished easily. However, because the direction of each fluid port is fixedly determined, the piping of the refrigeration circuit must be carefully arranged to mate with each port. Thus, fitting is complicated and obtaining a good seal is difficult.

One prior art solution to the above problem is shown in FIGS. 2*a* and 2*b*. FIG. 2*a* is a plan view and FIG. 2*b* is a cross-sectional view of a receiver dryer which partially solves the fitting problem. An upper opening of cylindrical body 2' is covered by plate 4. Fluid inlet port 3*a'* and fluid outlet port 3*b'* are rotatably fastened on cylindrical body 2' through plate 4 by bolts 5*a* and 5*b*. Bolts 5*a* and 5*b* set the position of the fluid ports 3*a* and 3*b*. However, as shown in the figures, the rotating range of each port is limited and interference between the fluid ports is likely. Thus, this device does not totally resolve the problem of fitting and sealing the receiver dryer to the refrigeration circuit.

SUMMARY OF THE INVENTION

It is an object of this invention to provide an improved receiver dryer for a refrigeration circuit wherein the piping is easily arranged.

It is another object of this invention to provide a receiver dryer for a refrigeration circuit wherein the placement of fluid ports is variable.

It is still another object of this invention to provide a receiver dryer for a refrigeration circuit wherein sealing of the fluid ports is improved.

It is still another object of this invention to accomplish the above objects with a receiver dryer that is simple in construction and easy to manufacture.

A receiver dryer for a refrigeration circuit in accordance with this invention includes a cylindrical body with an upper opening and a header portion disposed on the upper opening. The header portion is provided with a fluid inlet port and a fluid outlet port. The header portion includes a cover plate which is formed as a step-like structure. A flat surface is defined on both segments of the step-like structure, and a fluid port is disposed on each flat surface. Each fluid port is rotatably attached to the cover plate.

In a preferred embodiment of this invention, the fluid ports are provided with universal coupling mechanisms. The fluid ports each comprise a connector fixedly disposed on the cover plate of the header portion. The connector is provided with a central hollow portion and a radial hole. Each fluid port further comprises a port member rotatably supported on the connector. The port member is provided with an axial hollow portion which, together with the central hollow portion and radial hole of the connector forms a fluid passageway from the interior of the receiver dryer to the refrigeration circuit. The position of each end opening of the axial hollow portion can be selected easily by rotating the port member. Communication between the central hollow portion and axial hollow portion is maintained during rotation. The connector has two surfaces which are opposed to one another. A gap between these surfaces contacts the opposite side surfaces of the port members, which comprise a spherical portion and an edge portion, to form a seal. Therefore, sealing between the various parts of the port member is accomplished easily and simply.

Various additional advantages and features of novelty which characterize the invention are further pointed out in the claims that follow. However, for a better understanding of the invention and its advantages, reference should be made to the accompanying drawings and descriptive matter which illustrate and describe the preferred embodiment of the invention.

DETAILED DESCRIPTION OF THE PREFERRED EMBODIMENT

Figure 1A:
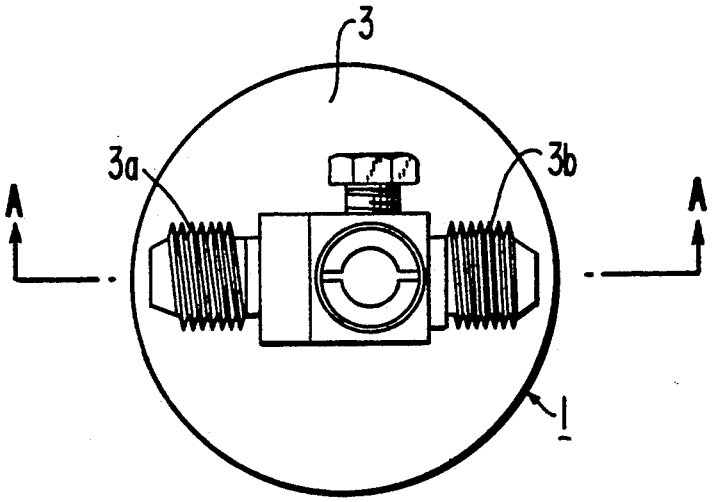
FIG. 1a PRIOR ART
FIG. 1*a* shows a plan view of an earlier version of a receiver dryer.
Figure 1B:
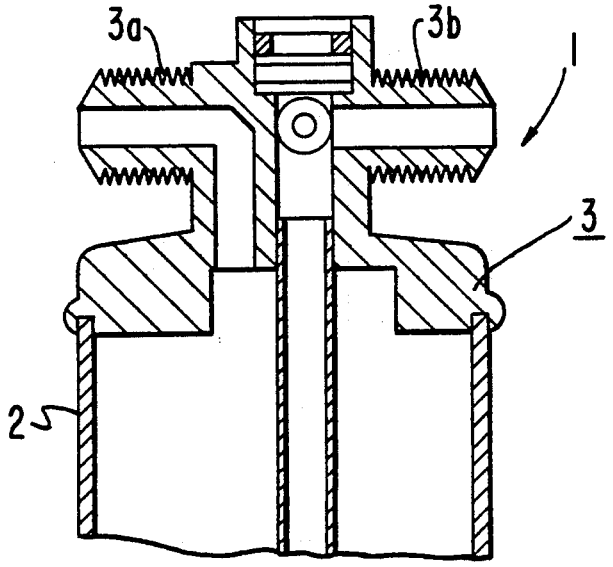
FIG. 1b PRIOR ART
FIG. 1*b* shows a cross-sectional view of an earlier version of a receiver dryer taken along line A—A in FIG. 1*a*.
Figure 2A:
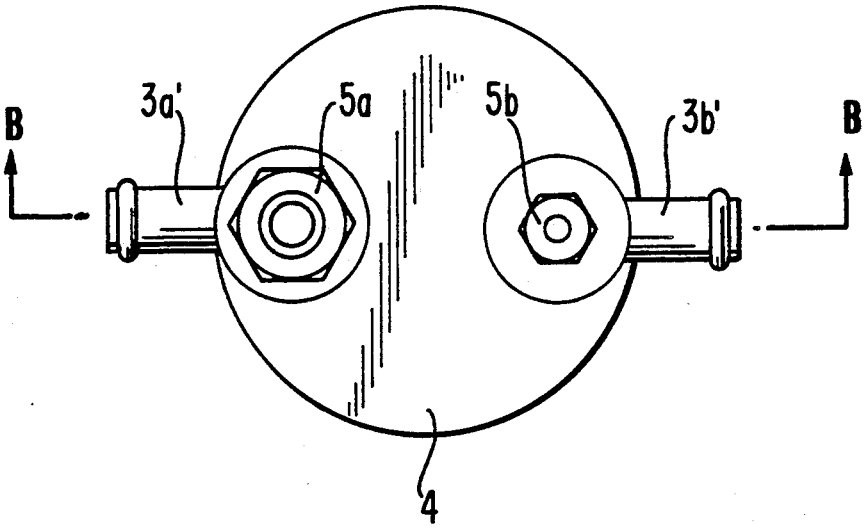
FIG. 2a PRIOR ART
FIG. 2*a* shows a plan view of another embodiment of an earlier version of a receiver dryer.
Figure 2B:
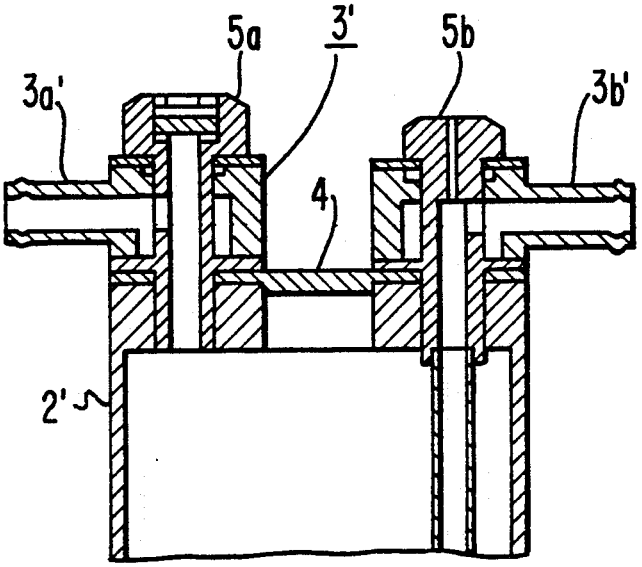
FIG. 2b PRIOR ART
FIG. 2*b* shows a cross-sectional view of an earlier version of a receiver dryer taken along line B—B in FIG. 2*a*.
Figure 3:
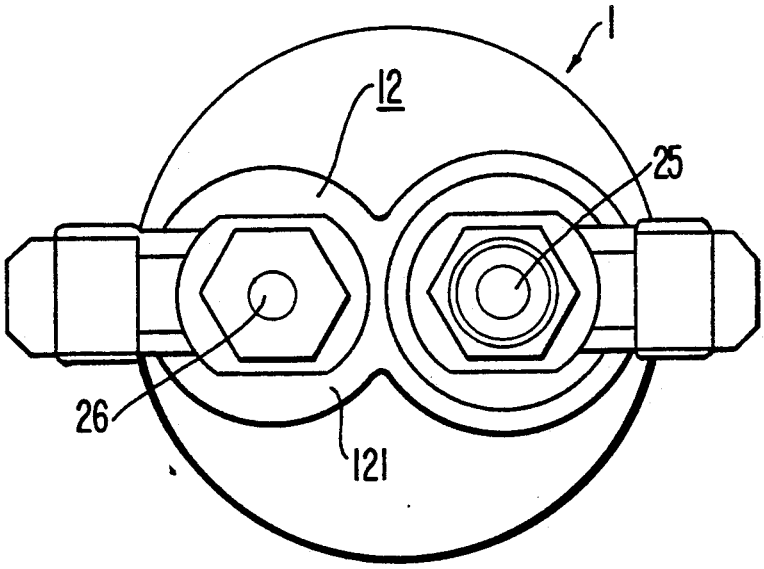
FIG. 3 shows a plan view of a receiver dryer in accordance with the present invention.
Figure 4:
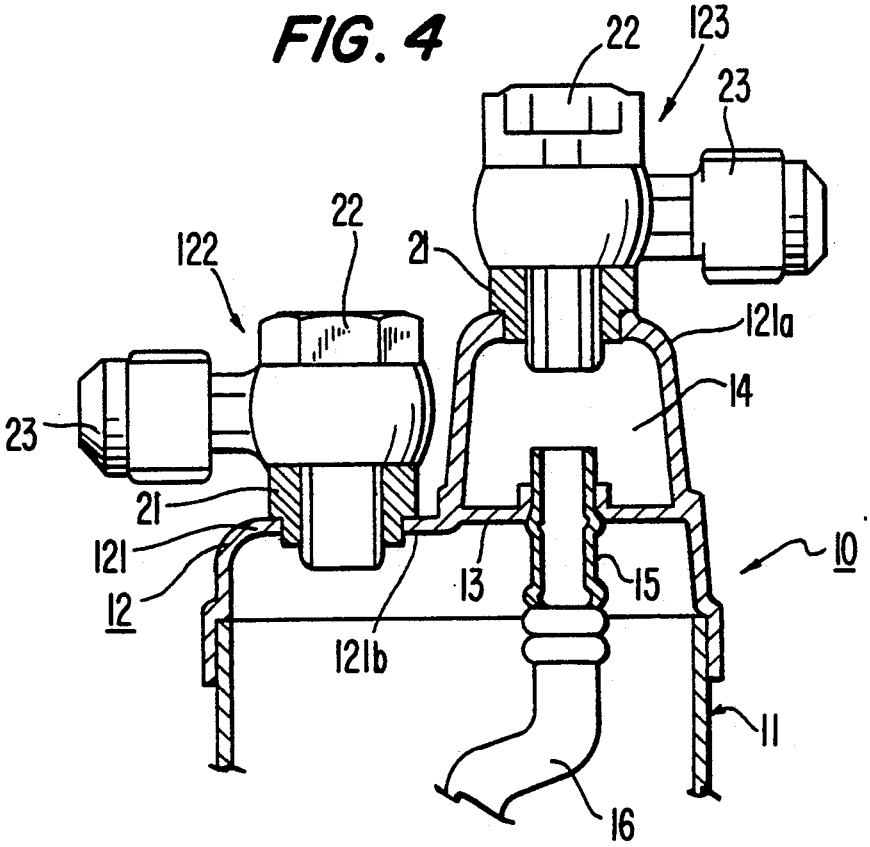
FIG. 4 shows a partial sectional view of the receiver dryer in FIG. 3.

Referring to the figures, wherein like numerals indicate like elements, FIGS. 3 and 4 show a receiver dryer according to this invention for use in an automobile air conditioning apparatus. Receiver dryer 10 includes cylindrical body 11 with an upper opening and header portion 12 which is disposed and welded on the upper opening.

Header portion 12 comprises cover plate 121, fluid inlet port member 122 and fluid outlet port member 123. Cover plate 121 is provided with U-shaped projecting portion 121*a* and flat portion 121*b* which create a step. Bottom portion of projecting portion 121*a* is covered by plate 13 to define small space 14 within projecting portion 121*a*. The interior of small space 14 communicates with the interior of cylindrical body 11 through pipe element 15. Pipe element 15 is connected to induction tube 16 which vertically extends into cylindrical body 11. Fluid inlet port member 122 is disposed within flat portion 121*b* and fluid outlet port member 123 is disposed within projecting portion 121*a*. Thus, fluid inlet port member 122 and fluid outlet port member 123 are arranged on header portion 12 to communicate between the interior of receiver dryer 10 and the refrigeration circuit of the air conditioning apparatus.

Figure 5:
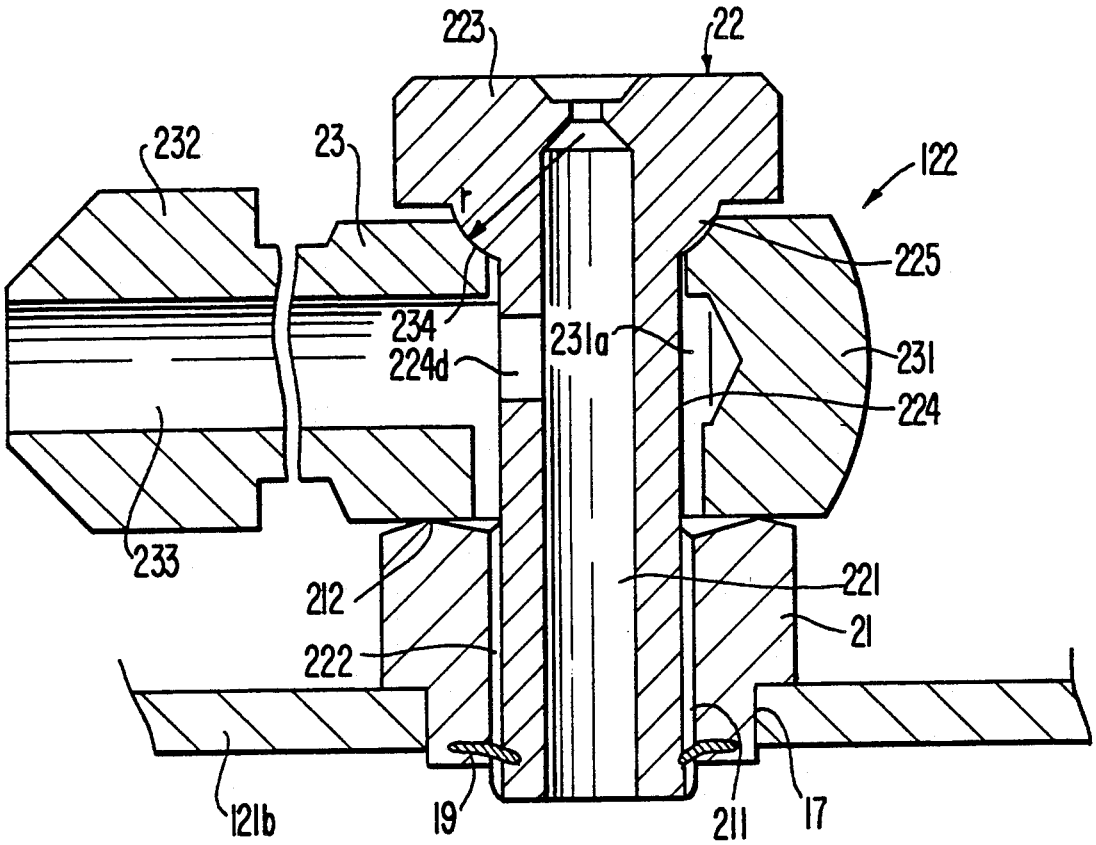
FIG. 5 shows an enlarged sectional view illustrating the port member of receiver dryer in FIG. 3.
Figure 6:
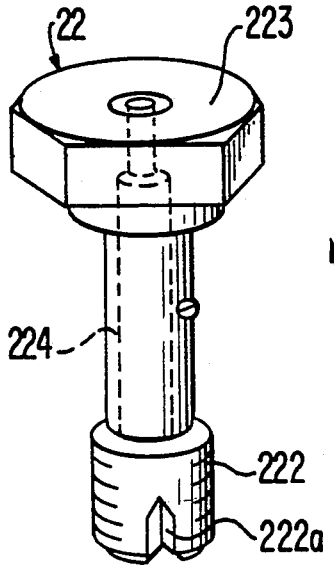
FIG. 6 shows a perspective view of the connector of the port member in FIG. 5.
Figure 7:
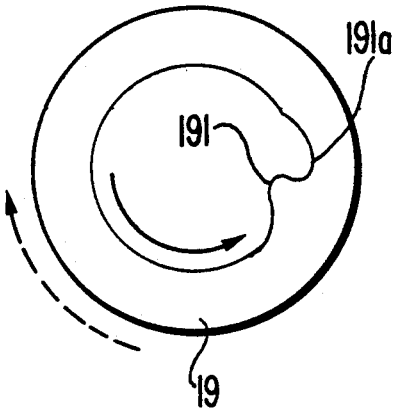
FIG. 7 shows a plan view of a snap ring used in FIG. 5.

FIGS. 5–7 illustrate the construction of the fluid port members using fluid inlet port member 122 as an example. Fluid inlet port member 122 comprises support element 21 welded or brazed on hole 17 of flat portion 121*b*. Support element 21 supports connector 22. Connector 22 is provided with central hollow portion 221 extending into the interior of cylindrical body 11. Port element 23 is rotatably fitted on connector 22.

Support element 21 has threaded hole 211 axially formed at its center and edge ring 212 formed on its outer surface concentric with threaded hole 211. Connector 22 comprises threaded portion 222, at one end, which is screwed into threaded hole 211. Collar portion 223 is formed at the other end, and body portion 224 is formed in between. Connector 22 further comprises a connecting portion between collar portion 223 and body element 224. This connecting portion comprises spherical surface 225 which has a radius "r." The surface hardness of edge ring 212 and spherical surface 225 should be hardened by hardness surface treatment or quenching.

Port element 23 comprises ring-shaped body portion 231 with cavity 231*a* and port portion 232 which extends radially from the outer peripheral surface of body portion 231. Port portion 232 has hollow portion 233 facing the interior of cavity 231*a*. Port portion 232 communicates with hollow portion 221 of connector 22 through radial hole 224*a* in body element 224. Beveled portion 234 of port element 23 contacts spherical surface 225. Port element 23 is formed of slightly softer material than connector 22, for example, an aluminum ally A locking mechanism for connector 22 comprises snap ring 19 disposed on the lower portion of threaded hole 211 of support element 21 and V-shaped groove 222*a* vertically formed on threaded portion 222 of connector 22. As shown in FIG. 7, snap ring 19 is provided with projection 191 which projects radially inwardly from its inner edge surface. One side of projection 191 slopes gently to the inner edge surface of snap ring 19. The other side of projection 191 slopes steeply to the inner edge surface of snap ring 19 and leads into depressed portion 191*a*. Thus, when threaded portion 222 of connector 22 is rotated counterclockwise, as shown by the solid arrow in FIG. 7, threaded portion 222 contacts the gently sloping portion of the inner edge surface of projection 191. Connector 22 is smoothly screwed into support element 21. Conversely, if connector 22 is rotated clockwise, as shown by the dotted arrow in FIG. 7, V-shaped groove 222*a* of threaded portion 222 contacts projection 191 on the steeply sloped side. This engagement between projection 191 and V-shaped groove 222*a* prevents rotation of connector 22. When connector 22 is rotated within support element 21, spherical surface 225 and edge ring 212 engage opposite side surfaces of body portion 231 of port element 23 and clamp it into place. The locking mechanism, which maintains port element 23 in its rigid position, is not dislodged by vibration or other forces.

Fluid inlet port member 122 and fluid outlet port member 123 comprise similar elements as described above. There are two differences. Fluid outlet port member 123 has, in addition, sight glass 25 placed on the outer opening of the hollow portion of fluid outlet connector 22. Fusible plug 26 is disposed on the outer end opening of the hollow portion of fluid inlet connector 22.

In operation, port element 23, placed on projecting portion 121*a*, can be fully rotated 360° around connector 22. Port element 23, placed on flat portion 121*b*, can be rotated more than 180°. Thus, the piping arrangement of the refrigeration circuit can be operated easily without interference between the two fluid ports. Furthermore, because sealing of the ports is accomplished by metal on metal contact, construction is simple and the performance of the sealing does not deteriorate over time.

Numerous characteristics, advantages and embodiments of the invention have been described in detail in the foregoing description with reference to the accompanying drawings. The disclosure, however, is illustrative only and it is to be understood that the invention is not limited to the precise illustrated embodiments. Various changes and modifications may be effected therein by one skilled in the art without departing from the scope or spirit of the invention.

I claim:

1. In a receiver dryer for a refrigeration circuit including a cylindrical body with an upper opening and a header portion disposed on the upper opening of said cylindrical body, said header portion being provided with a fluid inlet port member and a fluid outlet port member to communicate with the refrigeration circuit, the improvement comprising:

said header portion having a cover plate, said cover plate being a step-like structure with a lower flat surface portion and an upper flat surface portion, said fluid inlet port member being rotatably disposed on one of said flat surface portions and said fluid outlet port member being rotatably disposed on the other of said flat surface portions, one of said fluid inlet port or fluid outlet port being rotatable without interfering with the other said port or other elements of the receiver dryer.

2. A receiver dryer for a refrigeration circuit as set forth in claim 1 wherein said fluid inlet port member is rotatably disposed on said lower flat surface portion and said fluid outlet port member is rotatably disposed on said upper flat surface portion.

3. A receiver dryer for a refrigeration circuit as set forth in claim 1 wherein said step-like cover plate is defined by an upper U-shaped projection and a lower flat portion.

4. A receiver dryer for a refrigeration circuit as set forth in claim 1 wherein said fluid port members include a universal coupling mechanism.

5. A receiver dryer for a refrigeration circuit as set forth in claim 4 wherein said fluid port members comprise a connecting member fixedly mounted on said cover plate, said connecting member having a central hollow portion and a radial hole which form a fluid passageway from the interior of said cylindrical body to a port element which is rotatably supported on said connecting member and has an axial hollow portion to complete the fluid passageway to the external refrigeration circuit.

6. A receiver dryer for a refrigeration circuit as set forth in claim 5 wherein said connecting member has two facing surfaces which are separated by a gap between said facing surfaces for contacting said port element and sealing said header portion, said surfaces comprising a spherical portion and an edge portion.

7. A receiver dryer for a refrigeration circuit as set forth in claim 1 wherein at least the port member disposed on the upper flat surface portion is capable of being rotated 360°.

8. A receiver dryer as in claim 1, wherein one of said fluid inlet port or fluid outlet port can be rotated 360°.

9. A receiver dryer as in claim 8, wherein the other of said fluid inlet port or fluid outlet port can be rotated more than 180°.

* * * * *